US006179950B1

(12) United States Patent
Zhang et al.

(10) Patent No.: US 6,179,950 B1
(45) Date of Patent: Jan. 30, 2001

(54) POLISHING PAD AND PROCESS FOR FORMING SAME

(75) Inventors: Guoqiang (David) Zhang, Ballwin; Ralph V. Vogelgesang, Old Monroe; Gregory Potts, Columbia; Henry F. Erk, St. Louis, all of MO (US)

(73) Assignee: MEMC Electronic Materials, Inc., St. Peters, MO (US)

( * ) Notice: Under 35 U.S.C. 154(b), the term of this patent shall be extended for 0 days.

(21) Appl. No.: 09/252,698

(22) Filed: Feb. 18, 1999

(51) Int. Cl.[7] ..... B32B 31/00

(52) U.S. Cl. ..... 156/258; 156/304.5; 156/266; 156/304.1; 428/60; 428/66.2

(58) Field of Search ..... 156/258, 159, 156/304.5, 266, 304.1; 428/60, 66.2, 64.1

(56) References Cited

U.S. PATENT DOCUMENTS

| | | | | |
|---|---|---|---|---|
| 3,053,020 | | 9/1962 | Bratton | 451/531 |
| 4,240,855 | * | 12/1980 | Pennington | 156/159 |
| 4,755,429 | * | 7/1988 | Nickols et al. | 428/408 |
| 4,923,540 | * | 5/1990 | Born et al. | 156/86 |
| 5,593,537 | | 1/1997 | Cote et al. | 438/692 |

FOREIGN PATENT DOCUMENTS 60-048264 3/1985 (JP) .

* cited by examiner

*Primary Examiner*—Linda L Gray
(74) *Attorney, Agent, or Firm*—Senniger, Powers, Leavitt & Roedel

(57) ABSTRACT

A process for joining together a first polishing pad with a second polishing pad to form a larger pad for a machine that performs chemical-mechanical polishing of silicon wafers. The process includes laying a first polishing pad on a surface and laying a second pad on the surface so that a portion of the second pad overlies a portion of the first pad, creating an overlap region. The first and second pads in the overlap region are cut through to form a first cut edge on the first pad and a second cut edge on the second pad, the first and second cut edges having shapes which are complementary. The first and second cut edges are brought into engagement, and the first pad is joined to the second pad at the first and second cut edges. Cutting is done in a first direction that is generally opposite to a second direction that a polishing fluid is expected to move on an surface of the pad during operation of the polishing machine, thereby sloping the first and second cut edges away from the second direction to inhibit passage of polishing fluid between the first and second cut edges.

10 Claims, 1 Drawing Sheet

POLISHING PAD AND PROCESS FOR FORMING SAME

BACKGROUND OF THE INVENTION

This invention relates generally to semiconductor wafer polishing, and in particular to a method for joining sections of wafer polishing pads to form a larger, compound pad that is flat and inhibits leakage of polishing fluid.

Semiconductor wafers are generally prepared from a single crystal ingot, such as a silicon ingot, which is sliced into individual wafers. Each wafer is subjected to a number of processing operations to facilitate the installation of integrated circuit devices and to improve their yield, performance, and reliability. Typically, these operations reduce the thickness of the wafer, remove damage caused by the slicing operation, and create a flat and reflective surface. Chemical-mechanical polishing of semiconductor wafers is one technique to planarize wafer surfaces. It generally involves rubbing a wafer with a polishing pad in a solution containing an abrasive and chemicals, such as a colloidal silica and an alkaline etchant, to produce a surface that is extremely flat, highly reflective, and damage-free.

To maximize throughput in the preparation of semiconductor wafers, polishing machines are used to polish many wafers simultaneously. Polishing machines typically hold between 15 and 30 wafers in carriers that move relative to a rotating circular turntable, or platen, which is overlaid with a polishing pad. A stream of polishing solution, or slurry, is dispensed onto a surface of a pad while it is pressed against the wafers. Single-side polishing machines have one platen for polishing one side of wafers, while double-side polishing machines have two platens to simultaneously polish upper and lower sides of wafers. The platens are typically made of cast iron, and polishing pads are typically made of a polyurethane impregnated polyester felt having thickness between 1.5 and 2.0 mm. Pads are adhered to platen surfaces by an adhesive backing. The platen and polishing pad must be extremely flat to ensure that polished wafers are likewise extremely flat. During polishing, the wafer carriers and platen rotate in opposite directions for a predetermined time, a typical duration being 50 minutes.

Polishing machines that have platens of relatively large size are capable of polishing a greater quantity of wafers, thereby improving throughput relative to smaller platens. Machines with a platen diameter as great as 2000 mm are being used by silicon wafer manufacturers. However, pad manufacturers have generally not produced circular pads with diameter greater than about 1500 mm, nor produced rectangular pads that are sufficiently large to cut a 2000 mm diameter circle therefrom. As a result, smaller sectional polishing pads must be joined together to form a compound pad of larger size. Typically two semi-circular shaped pads are joined at a seam located along a diameter to form a circular-shaped compound pad.

Unfortunately, a seam where sectional pads are joined together is subject to leak. Polishing slurry can pass through gaps where a seam is not fully sealed to an underside of the pad where it contacts the platen. Moisture in the slurry causes the platen surface to quickly oxidize. Rust forms and contaminates the slurry, often spreading in the slurry back through the seam to the front side of the pad, where the rust diminishes pad life and causes iron contamination on wafers that substantially degrades wafer surface quality.

One potential solution is to seal seams with an applied bonding material, such as a spray sealant, to prevent slurry from passing through gaps and contacting platens. However, a sealant adds foreign material to a pad that is not uniformly distributed, creating local bumps and regions of irregular pad flexibility that degrade the pad's effective flatness, and subsequently degrade the flatness of wafers that are polished by the pads. Thus, sealing seams with applied bonding material is an inadequate solution.

SUMMARY OF THE INVENTION

Among the several objects and features of the present invention may be noted the provision of a process for joining together polishing pads to form a larger pad for a machine that performs chemical-mechanical polishing of silicon wafers; the provision of such a process that forms a pad that is uniformly flat across the pad; the provision of such a process that forms a pad that is free of applied bonding material; the provision of such a process that prevents iron contamination of wafers; the provision of a polishing pad formed of at least two adjacent polishing pads for covering a relatively large platen of a polishing machine; and the provision of such a process and pad that are economical.

In general, a process of the present invention for joining together a first polishing pad with a second polishing pad to form a larger pad for a machine that performs chemical-mechanical polishing of silicon wafers comprises laying a first polishing pad on a surface, and laying a second pad on the surface so that a portion of the second pad overlies a portion of the first pad, creating an overlap region. The first and second pads are cut through in the overlap region to form a first cut edge on the first pad and a second cut edge on the second pad. The shapes of the first and second cut edges are complementary. The first and second cut edges are brought into engagement, and the first pad is joined to the second pad at the first and second cut edges.

In another aspect, a compound polishing pad of the present invention for covering a platen of a machine that performs chemical-mechanical polishing of silicon wafers is formed of at least two adjacent polishing pads. The compound pad comprises a first pad constructed of a polishing material, the first pad being flat and having at least one edge that is beveled and inclined at a generally uniform angle along an entire length of the edge, and a second pad constructed of the polishing material, the second pad being flat and having at least one edge that is beveled and inclined at a generally uniform angle along an entire length of the edge. The angle of the beveled edge of the second pad matches the angle of the beveled edge of the first pad in a complementary manner, the beveled edges being in generally face-to-face engagement and joined together at a seam. A surface of the compound pad extends continuously through the seam.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
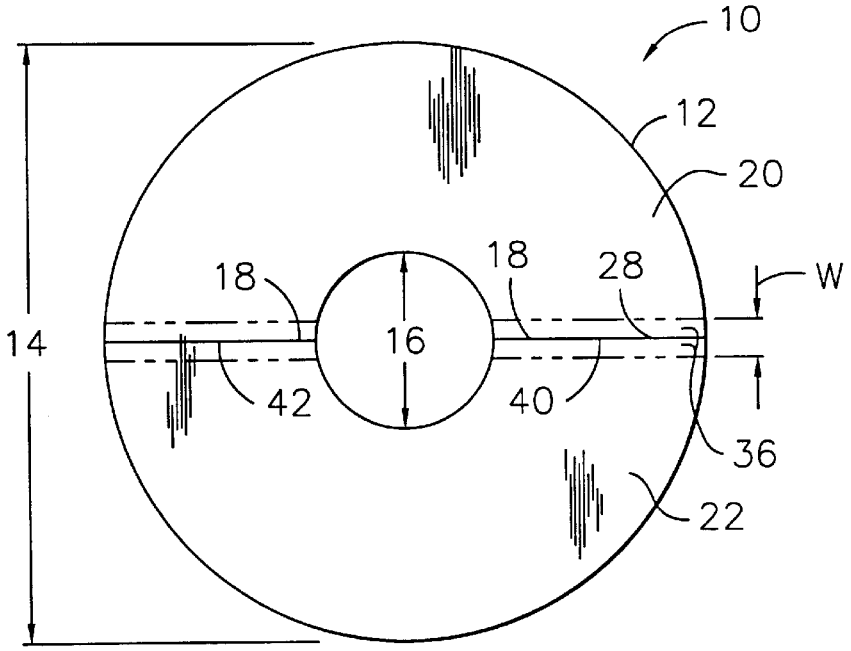
FIG. 1 is a plan view of a compound polishing pad of the present invention for covering a platen of a machine that performs chemical-mechanical polishing of silicon wafers.

Referring now to the drawings and in particular to FIG. 1, a compound polishing pad formed of two adjacent sections of pad for covering a platen of a machine that performs chemical-mechanical polishing of silicon wafers is indicated generally at 10. The polishing pad 10 is flat and generally shaped in the form of an annular circle 12 that correspondingly registers with the shape of the platen (not shown) when the pad covers the platen. An outer diameter 14 of the pad 10 approximates an outer diameter of the platen, and an inner diameter 16 of the pad approximates an inner diameter of the platen. The pad 10 polishes silicon wafers when it is rubbed against wafers in the presence of a polishing fluid, typically while the platen and wafers rotate in opposite directions.

The pad 10 is a compound pad, formed by joining at a seam 18 a first sectional pad 20 and a second sectional pad 22. In the preferred embodiment, the first and second sectional pads 20, 22 are joined at the seam 18 located substantially along a diameter 28 of the annular circle 12. However, it is envisioned that the compound pad 10 may be formed by joining together any number of sectional pads of any shape to form a combined pad that approximates a shape of a platen. In the preferred embodiment, each sectional pad is constructed of a polishing material, such as a polyurethane impregnated polyester felt, having a thickness between 1.5 and 2.0 mm. Typically, an underside of each pad is coated with an adhesive backing which is overlaid with a covering such as a glassy paper that is removable to expose the adhesive.

Figure 2:
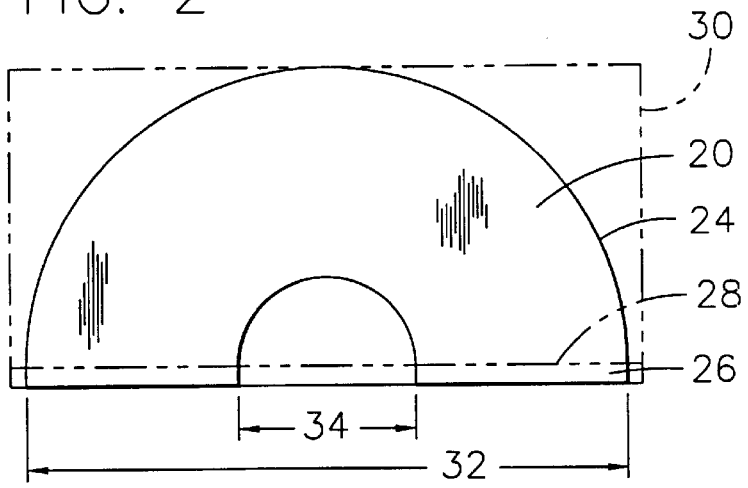
FIG. 2 is a plan view of a first sectional pad in the general shape of a semi-circle for joining with a second pad in the process of the present invention.

The sectional pads 20, 22 have a general shape of an annular semicircle 24, as seen in FIG. 2, with a relatively small strip 26 that extends past the diameter 28 defining an end of the semi-circle shape. If sectional pads 20, 22 are supplied in a rectangular shape 30 as shown in FIG. 2 or other non-semi-circular shape, the pads are trimmed with a knife or sharp tool to the desired semi-circle shape 24. In practice, it has been found useful for the pad 10 to be initially slightly oversized relative to the platen. For 2000 mm diameter pads, the strip 26 extends about 40 mm past the diameter 28 of the semi-circle 24, an outer diameter 32 of the semi-circle 24 is about 25 mm larger than the platen diameter, and an inner diameter 34 of the semi-circle is about 6mm smaller than an inner diameter of the platen.

The attachment of sectional pads 20, 22 at the seam 18 is a key part of a process according to the present invention for joining together the sectional pads to form the larger, compound pad 10. The process begins by laying the first sectional pad 20 on a surface of the platen. The first pad is carefully located on the platen so that the semi-circle 24 of the pad 20 is aligned with the circle of the platen. The first pad 20 is secured to the platen by sequentially lifting small sections of the pad, removing a section of the glassy paper to expose the adhesive, and lowering the section of pad to the platen while carefully avoiding gaps or bubbles between the pad and platen. The first pad 20 adheres to the platen after gently pressing the pad against the platen using a roller or by hand. The small strip 26 of the first pad 20 that extends beyond the diameter 28 defining the end of the semi-circle 24 is not pressed, so that the strip is not adhered to the platen. The second pad 22 is laid on the surface of the platen, aligned with the platen and located as seen in FIG. 1 so that a portion of the second pad overlies a portion of the first pad 20, creating an overlap region 36. In the preferred embodiment, the pads 20, 22 are sized and located so that a width W of the overlap region 36 is between 50 and 80 mm for a 2000 mm diameter pad 10. Overlap regions of other sizes are envisioned to be within the scope of this invention. Glassy paper covering the adhesive backing of the second pad 22 is carefully removed, exposing the adhesive so that the second pad adheres to the platen after gently pressing the pad against the platen, in the same manner as the first pad 20. The portion of the second pad 22 in the overlap region 36 is not pressed, so that portion is not adhered to the platen. The inner and outer circumferences of the pads 20, 22 are trimmed to match the inner and outer circumferences of the platen.

The first and second pads 20, 22 are cut in the overlap region 36 using a sharp knife or other cutting implement. The step of cutting is generally done in a straight line, along the diameter 28 of the annular circle 12, and at a fixed angle of inclination 38 relative to the surface of the platen. A first cut 40 is made that extends across one-half of the overlapping pads 20, 22 as shown in FIG. 1, and a second cut 42 is made, aligned with the first cut, that extends across the other half of the pads. A straight edge or guide tool is typically used as an aid for cutting generally straight lines. Each cut 40, 42 severs a piece of the first pad 20 and simultaneously severs a piece of the second pad 22 from the remaining extent of the pads, the pieces being approximately equal to the strips 26 in the overlap region 36 that lie past the cut. Typically, the severed pieces have width between 25 and 38 mm for a 2000 mm diameter pad.

Figure 3:
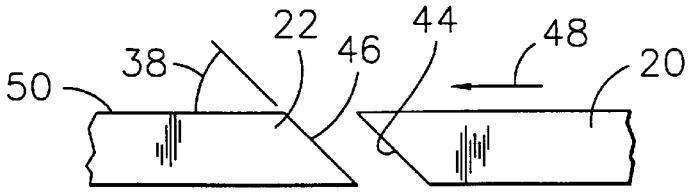
FIG. 3 is an sectional view of an overlap cut in the first and second pads.

The step of cutting the pads forms a first cut edge 44 on the first pad 20 and a second cut edge 46 on the second pad 22. The cutting implement is held at the generally uniform angle of inclination 38 relative to the surface during cutting, thereby forming the first cut edge 44 and the second cut edge 46 at the fixed angle 38 for an entire length of a cut. As seen in FIG. 3, the first and second cut edges 44, 46 have shapes which are complementary, since the edges are simultaneously formed by the same cutting motion, and the edges are generally in registration with each other. In the preferred embodiment, the angle of inclination 38 is between 45 and 60 degrees relative to the flat surface of the pad 10 to form beveled edges 44, 46.

The orientation of the angle of inclination 38 is selectively chosen to slope the edges 44, 46 away from a direction of travel 48 of polishing fluid on the pad 10. Platens and pads are rotated in a first direction (such as clockwise), and wafer carriers and polishing fluid generally rotate in a second direction (such as counter clockwise) that is opposite the first direction. The step of cutting is done while inclining the knife to cut in the first direction (i.e., a cut edge extends from a pad's front, polishing side 50 to the platen generally in the first direction). The first and second cut edges 44, 46 are sloped away from the expected direction of travel 48 of polishing fluid to inhibit passage of fluid between the first and second cut edges. As a result, the first and second cuts 40, 42 are made in opposite directions from each other.

After cutting, the severed pieces are removed, and the cut edges 44, 46 are brought into engagement. The first and second pads 20, 22 are pressed against the surface of the platen, which simultaneously presses the first and second cut edges 44, 46 together, for an interval of time. In the preferred embodiment, the pads 20, 22 are pressed by applying a force of at least about 1500 dN for an interval between one and two hours to tightly bond the first pad to the second pad. The polyurethane and polyester of one pad naturally bond with the identical material of the other pad when pressed together in this manner. For double side polishing machines, the step of pressing the pads 20, 22 together is typically accomplished by operating the machine to press the upper platen against the lower platen. For single side polishing machines, the step of pressing the pads 20, 22 together may be done by pressing a polishing block or other tool against the pads and platen.

In practice, the seams 18 formed by this process are not visible on the compound pads 10. The compound pad 10 is free of any applied bonding material, and the pad is sealed so that passage of polishing fluid or rust through the cut is inhibited. The pad 10 has a polishing surface 50 which extends continuously through the seam, is uniformly flat and can polish wafers to a high surface quality and extreme flatness.

For double side polishing machines, the process is performed at least once to form a polishing pad 10 for covering a lower platen, and is repeated at least once to form a polishing pad 10 for covering an upper platen, thereby providing pads for both platens. For the top platen, the sectional pads 20, 22 are placed on the lower platen with adhesive side facing up. After the glassy paper protective backing is peeled off, the upper platen is lowered until the sectional pads 20, 22 adhere to the upper platen. The step of cutting is done similar as that for the lower platen, but cutting in a generally upwardly direction.

In view of the above, it will be seen that the several objects of the invention are achieved and other advantageous results obtained.

As various changes could be made in the above without departing from the scope of the invention, it is intended that all matter contained in the above description and shown in the accompanying drawings shall be interpreted as illustrative and not in a limiting sense.

What is claimed is:

1. A process for joining together a first polishing pad with a second polishing pad to form a larger pad for a machine that performs chemical-mechanical polishing of silicon wafers, the process comprising:

laying a first polishing pad on a surface;

laying a second pad on the surface so that a portion of the second pad overlies a portion of the first pad, creating an overlap region;

cutting through the first and second pads in the overlap region to form a first cut edge on the first pad and a second cut edge on the second pad, the first and second cut edges having shapes which are complementary, and wherein the step of cutting is done in a first direction that is generally opposite to a second direction that a polishing fluid is expected to move on a surface of the pad during operation of said polishing machine, thereby sloping the first and second cut edges away from the second direction to inhibit passage of the polishing fluid between the first and second cut edges;

bringing the first and second cut edges into engagement; and joining the first pad to the second pad at the first and second cut edges.

2. A process as set forth in claim 1 wherein the step of cutting is done using a cutting implement held at a generally uniform angle of inclination relative to the surface during cutting, thereby forming the first cut edge and the second cut edge at the fixed angle for an entire length of a cut.

3. A process as set forth in claim 2 wherein the step of cutting is done with the angle of inclination being an acute angle.

4. A process as set forth in claim 2 where the angle of inclination is between 45 and 60 degrees relative to the surface.

5. A process as set forth in claim 1 further comprising the step of pressing the first and second pads against the surface for an interval so that the first cut edge on the first pad bonds with the complementary second cut edge on the second pad in a flat manner free of any applied bonding material, thereby joining the pads.

6. A process as set forth in claim 5 wherein the step of pressing is done while applying a force of about 1500 dN or more for an interval of about one hour or longer.

7. A process as set forth in claim 1 wherein the process is performed at least once to form a polishing pad for covering a lower surface of a double-side polishing machine, and is repeated at least once to form a polishing pad for covering an upper surface of the machine, thereby to provide pads for both surfaces of the machine.

8. A process as set forth in claim 1 wherein the step of laying a first polishing pad includes attaching the first pad to the surface, and the step of laying a second pad includes attaching the second pad to the surface generally adjacent the first pad.

9. A process as set forth in claim 1 wherein the step of cutting includes making a first cut extending across a first half of the pads and a second cut extending across a second half of the pads.

10. A process as set forth in claim 9 wherein the first and second cuts are both made in said first direction that is generally opposite to said second direction, and wherein the two cuts are generally aligned.

* * * * *